US005450680A

United States Patent [19]

Bromberg

[11] Patent Number: 5,450,680

[45] Date of Patent: Sep. 19, 1995

[54] POP-UP CARD AND METHOD OF MAKING SAME

[75] Inventor: Howard M. Bromberg, Riverdale, N.Y.

[73] Assignee: The Flexi/Group, Inc., Riverdale, N.Y.

[21] Appl. No.: 146,906

[22] Filed: Nov. 1, 1993

[51] Int. Cl.[6] ..... G09F 1/08

[52] U.S. Cl. ..... 40/124.1; 40/491

[58] Field of Search ..... 40/124.1, 539, 488, 40/491; 446/148, 151

[56] References Cited

U.S. PATENT DOCUMENTS

| | | | |
|---|---|---|---|
| 2,485,806 | 10/1949 | Berg | 40/488 |
| 2,757,468 | 8/1956 | Cain | 40/124.1 |
| 3,025,767 | 3/1962 | Ruffalo . | |
| 3,191,328 | 6/1965 | Lohnes | 40/124.1 |
| 3,441,208 | 4/1969 | Goldstein . | |
| 3,798,806 | 3/1974 | Sanford . | |
| 3,834,051 | 9/1974 | Barnes, Jr. et al. | 40/124.1 |
| 3,902,656 | 9/1975 | Rothchild . | |
| 3,946,508 | 3/1976 | Booras | 40/124.1 |
| 4,132,348 | 1/1979 | Bromberg . | |
| 4,161,833 | 7/1979 | Wagner | 40/124.1 X |
| 4,262,939 | 4/1981 | Schoettle, Jr. . | |
| 4,586,279 | 5/1986 | Hopkins | 446/151 X |
| 4,697,364 | 10/1987 | Dean | 40/491 X |
| 4,938,344 | 7/1990 | McHale et al. . | |
| 5,083,389 | 1/1992 | Alperin | 40/539 |
| 5,096,751 | 3/1992 | Dochek . | |
| 5,259,133 | 11/1993 | Burtch | 40/124.1 |

*Primary Examiner*—Kenneth Dorner
*Assistant Examiner*—Joanne Silbermann
*Attorney, Agent, or Firm*—Herbert Dubno

[57] ABSTRACT

A pop-up card in which the cutout portion of the front part is attached to a slide panel which extends the full width of the card and can be liberated by removal of a tear-away strip so that the slide panel can pull the cut-out portion into its erect position. This arrangement eliminates the need for especially providing stationary rails to guide the cutout portion.

18 Claims, 9 Drawing Sheets

FIG. 8
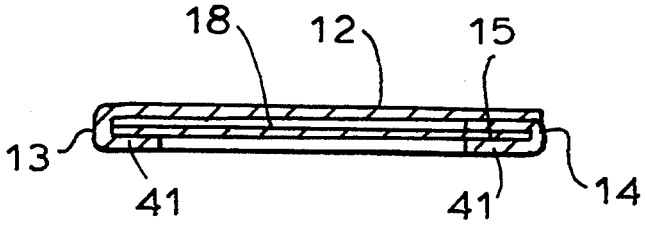
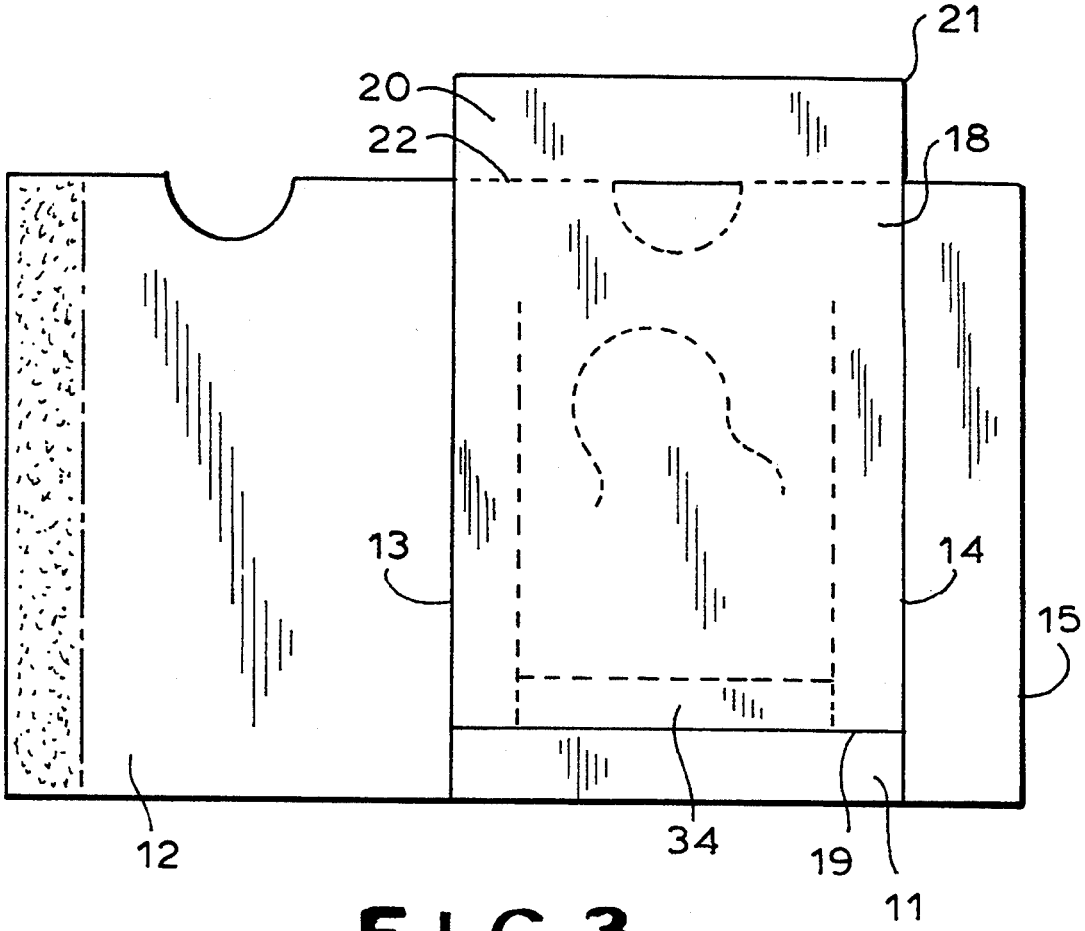
FIG. 3

FIG. 6
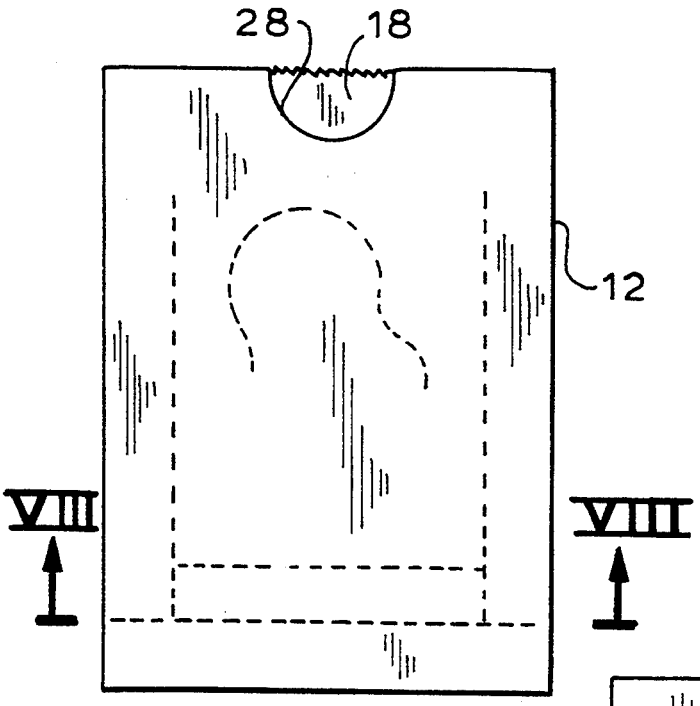
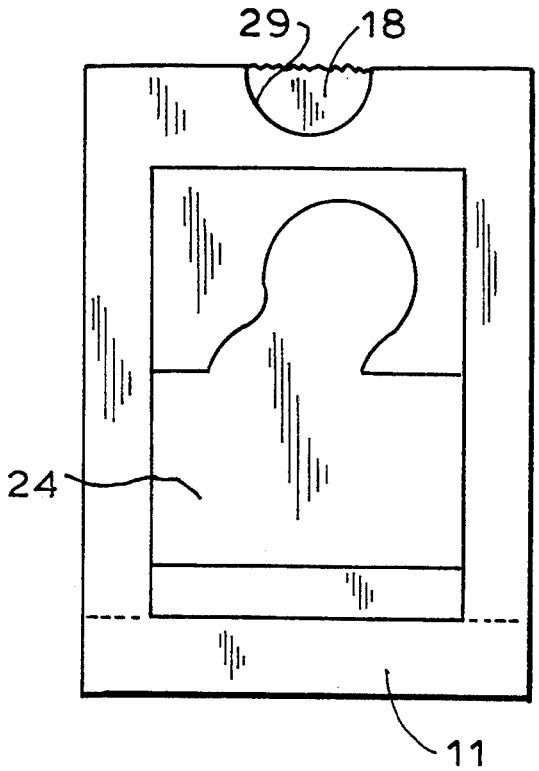
FIG. 7
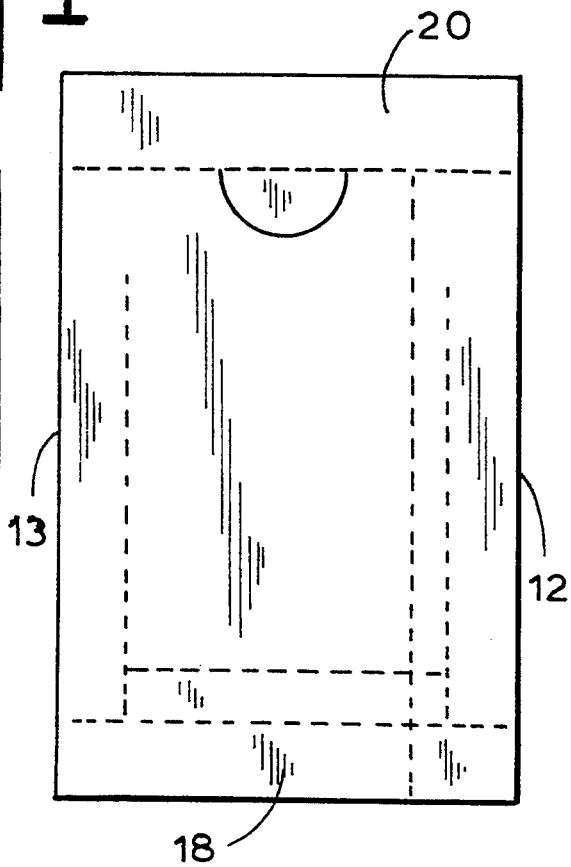
FIG. 5

FIG. 9
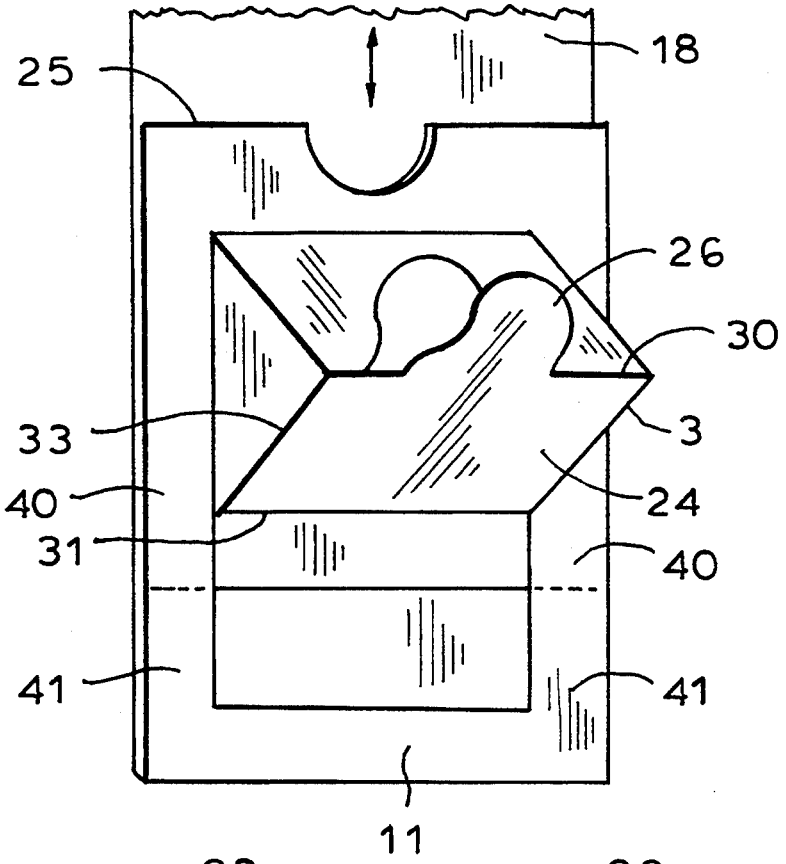
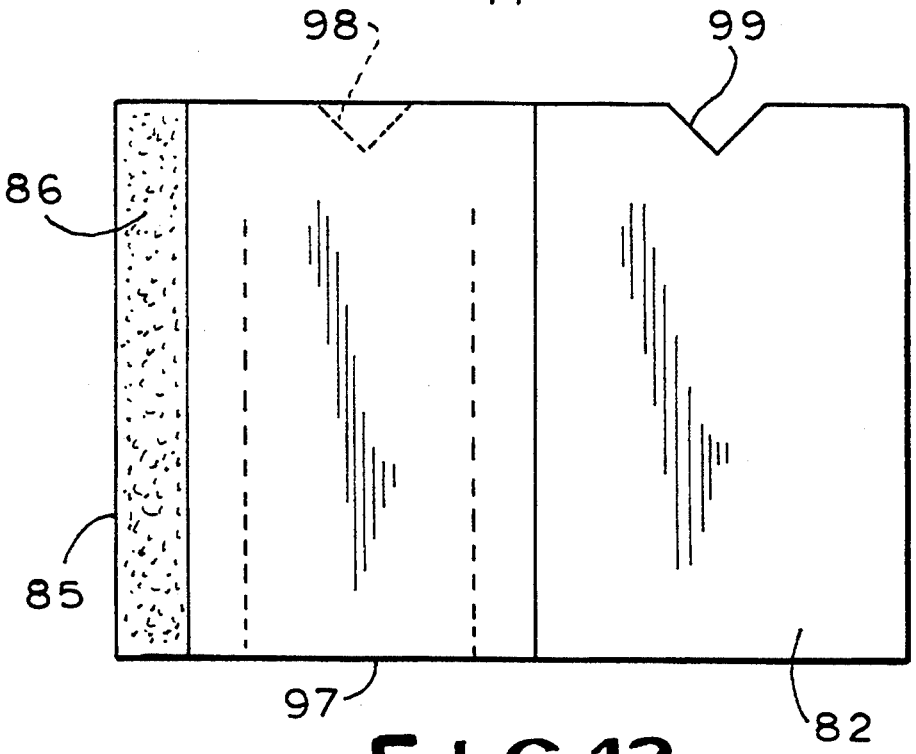
FIG. 13

FIG. 12
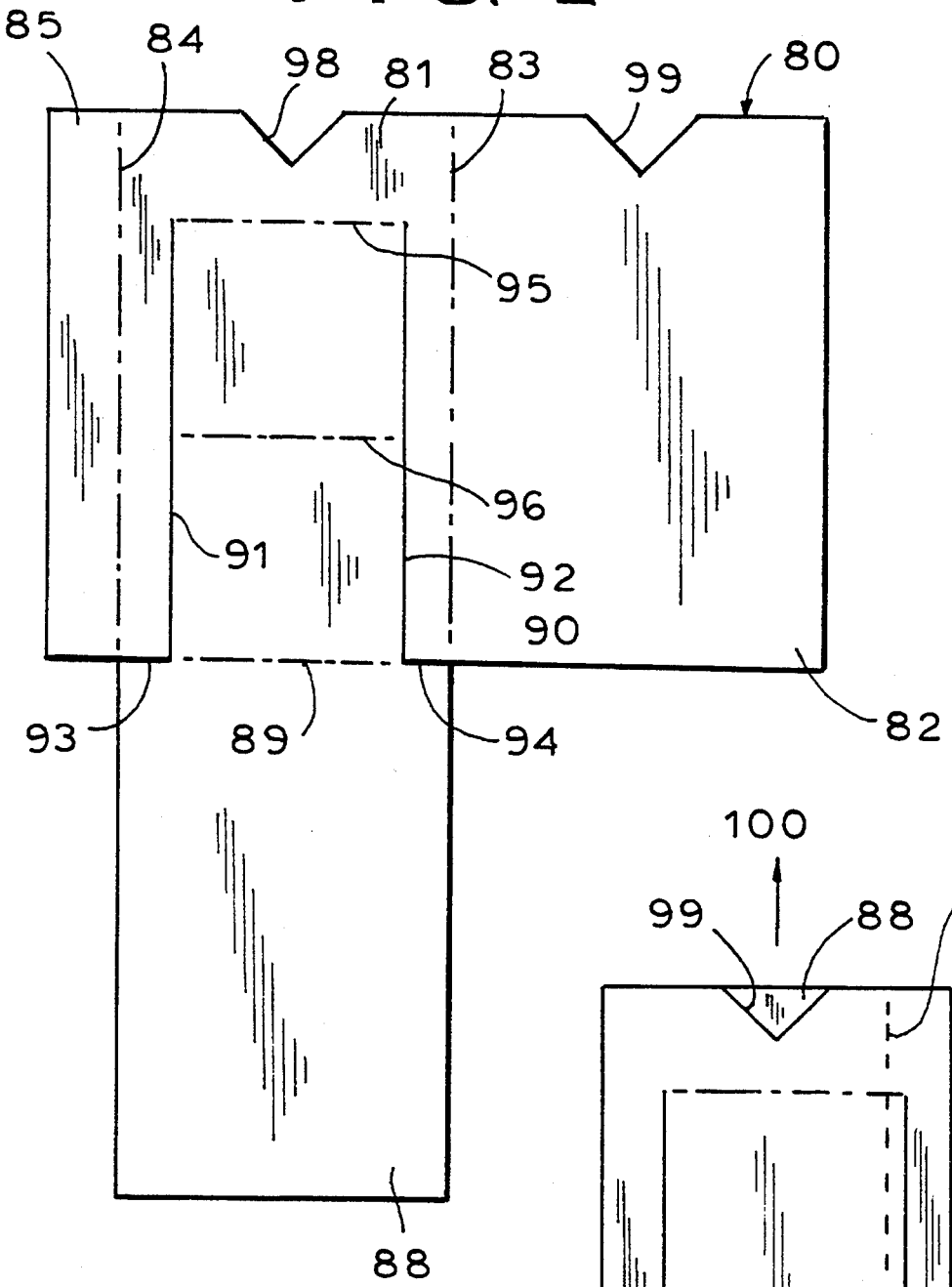
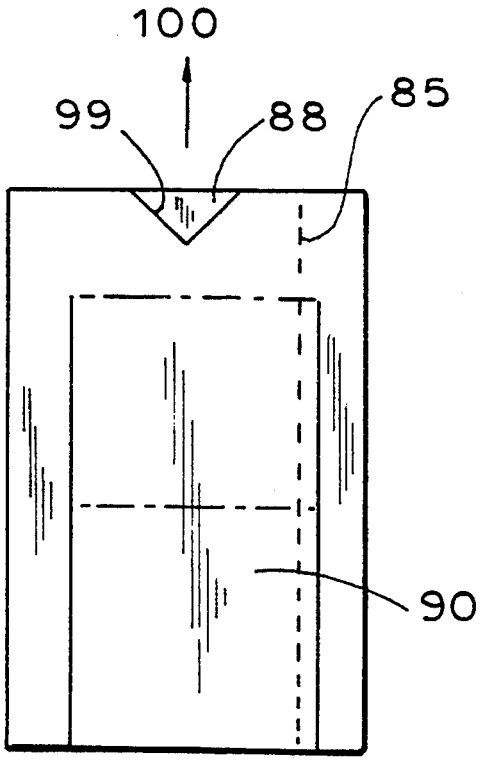
FIG. 14

POP-UP CARD AND METHOD OF MAKING SAME

FIELD OF THE INVENTION

My present invention relates to a pop-up card and, more particularly, to a pop-up card of the type in which a slide between front and rear panels is movable by the user to cause a cutout portion of the front panel to be erected or to stand out from the balance of the front panel and provide a three-dimensional display.

The invention also relates to an improved method of making such a card.

BACKGROUND OF THE INVENTION

Pop-up cards are known in a variety of configurations and, for example, mention can be made of U.S. Pat. Nos. 5,096,751, 5,083,389, 4,938,344, 3,834,051 and 3,798,806, all of which disclose various techniques, in association with greeting cards or display cards or the like, for erecting a portion of a card by some action of the user.

More recently there has developed an interest in providing sports cards or the like in which the figure of an athlete can be portrayed in a cutout portion and can be erected on the card which can also carry printed matter relating to that athlete, e.g. in the nature of biographical details, athletic background and/or athletic achievement. Such cards may utilize a slide between front and rear panels of the card which can be actuated by a user to erect the cutout portion bearing the figure of the athlete.

Card devices utilizing slides between front and rear panels are themselves known in conjunction with slide rule type devices in a number of configurations and mention may be made in this connection of U.S. Pat. Nos. 3,025,767, 3,441,208, 3,902,656, 4,132,348, 4,262,939, in addition to the patent document cited therein.

For the most part, in the past, the devices have required rails along the lateral edges of the erectable structure for effectively guiding them, complex die cutting arrangements and complicated fabrication methods with respect to the gluing techniques.

While the last mentioned patents also include patents which disclose the use of tear-away strips to liberate the slide, as far as I am aware, no earlier system for the fabrication of pop-up cards has been able effectively to utilize a tear-away strip designed to render the movable parts of such a card actuatable by the user, or to provide a system in which a tear-away strip could maintain the movable parts of a pop-up card in an immovable state until the user was prepared to actuate the same, thereby ensuring that the pop-up card would reach the consumer in a totally intact state ready for use.

OBJECTS OF THE INVENTION

It is, therefore, the principal object of the present invention to provide an improved pop-up card which can be fabricated conveniently, simply and economically, yet is free from the disadvantages of pop-up cards and slide systems requiring lateral guide rails.

Another object of this invention is to provide an improved pop-up card which can be reliably operated by the consumer as designed but which is provided with assurance against dislocation of the movable parts prior to intended use.

It is also an object of this invention to provide an improved method of making such a pop-up card.

SUMMARY OF THE INVENTION

These objects and others which will become apparent hereinafter are attained by providing a slide panel which can be attached to either the front panel or the rear panel, e.g. by gluing, to a cutout portion of that panel to enable that portion to be drawn toward a hinge or connection between the cutout portion and the balance of the panel having the cutout.

Since the slide panel is substantially the full width of the front and rear panels, no guide rails need be provided along the edges of the cutout portion to prevent dislocation thereof.

According to one aspect of the invention, the slide panel can be attached to either the front panel or the rear panel by a tear away strip. In that case, the entire blank can be formed in one piece and, upon folding of the die cut one piece blank and gluing the front and rear panels together to form a sleeve, the slide panel can be liberated to move and actuate the cut-out portion of the front or the rear panel proved therewith.

The tear-away strip, until it is torn away by the user, serves to maintain the useable parts of the card in readiness for such use.

According to another aspect of the invention, where the pop-up card is to be formed on a web press rather than by sheet-feed production, the slide is slit from the continuous web prior to final folding and is inserted between the front and rear panels which can be folded one onto the other, with a flap of one of the front and rear panels being then folded and glued onto the other, all in a continuous operation on the web press.

While the pop-up card in the latter case can also have tear-away portions at one or another or both ends of the folded card so that the slide can be liberated in the manner previously described upon use of the card and by the user, the tear-away strip or strips is or are by no means essential to benefit from the advantages of a web-feed production. The continuous production of the pop-up cards, the fact that the gluing need be effected on only one surface of the web as desired while any printing can have previously been supplied or can have been effected concurrently with or prior to the application of the glue, all provide unique advantages for this embodiment of the pop-up card.

The card, which can be rigid or semirigid paper, paperboard, plastic-coated paper or plastic stock, is preferably of the type described in which the cutout portion represents the figure of an athlete or other famous personality and can be imprinted with legible matter describing that personality, his or her prowess or his or her accomplishments. More particularly, a pop-up card of the present invention can comprise:

- a front panel bounded by edges and formed inwardly of the edges with cuts delimiting a pop-up portion of the front panel having a cutout adapted to be erected upon bending of the pop-up portion by drawing an extremity thereof toward a portion of the pop-up portion hinged to a remainder of the front panel;
- a slide panel of substantially a full width of the front panel, underlying the front panel and secured to the pop-up portion substantially at the extremity;
- a rear panel underlying the slide panel and connected to the front panel along one of the edges thereof, the front and rear panels sandwiching the slide panel between them; and, preferably, a tear-away strip connected by weakened lines with the slide panel and with one of the front and rear panels and provided with a fold between the weakened lines, the tear-away strip being separable from the pop-up card along the lines to free the slide panel to be displaced by a user to erect the cutout.

The front, slide and rear panels and the tear-away strip are preferably unitary with one another to form parts of a common die-cut blank and the tear-away strip can preferably connect the slide panel with the front panel.

The front panel can be formed unitarily with a flap along an edge thereof opposite the edge along which the rear panel is connected to the front panel, the flap being folded to underlie the front panel.

The method of making the card according to the invention can comprise the steps of:

die-cutting a blank of sheet material to form a front panel bounded by edges and formed inwardly of the edges with cuts delimiting a pop-up portion of the front panel having a cutout adapted to be erected upon bending of the pop-up portion by drawing an extremity thereof toward a portion of the pop-up portion hinged to a remainder of the front panel, a rear panel attached to the front panel and substantially coextensive therewith, a slide panel adapted to be sandwiched between the front and rear panels and of substantially a full width of the front panel, a flap along an edge of the front panel opposite an edge at which the rear panel is attached thereto, and a tear-away strip connected by weakened lines with the slide panel and with one of the front and rear panels;

folding the blank by providing a fold in the tear-away strip midway between the weakened lines so that the slide panel underlies the front panel, by folding the flap inwardly at the edge connecting the flap with the front panel so that the flap underlies the slide panel, and by folding the rear panel over the flap and the slide panel so that the rear panel underlies the slide panel;

securing the rear panel to the flap and securing the slide panel to the pop-up portion at the extremity of the pop-up portion; and tearing away the tear-away strip along the weakened lines to free the slide panel to be displaced by a user to erect the cutout.

In another aspect of the method of the invention, corresponding to the second embodiment of the pop-up card described, a continuous web is fed along a path and at respective stations along the path, the flap portion adjoining one of the front or rear panel portions is provided with glue and glue is also formed on the die cut portion which constitutes the cutout, the slide panel portion is slit to separate it from the other f the front and rear panel portions of the continuous web and is inserted between the front and rear panel portions which, also continuously, are folded one over the other to form the sleeve which is then closed by the flap, likewise continuously folded over. Only then is the web severed transversely to the fold lines and the direction of travel of the web to separate the individual pop-up cards from the web.

According to another feature of the invention common to both of the embodiments described, both the front and rear panels can be provided with cutouts, the respective cutout portions being glued to opposite sides of the full-width slide panel, so that when the latter is drawn by the user partly out of the sleeve, cutouts on both sides of the latter pop-up. It has been found that especially in the case of such a dual pop-up, the pop-up portions provide a spring action which tends automatically to draw the slide back into the sleeve when the slide is released by the user.

Of course, when the slide panel is connected at a hinge joint or fold to the pop-up portion, this hinge joint or fold can form an edge of the card opposite the edge provided with the notches so that the end of the pop-up portion which is not hinged to the front panel, need not be delimited by a cut. This construction has been found to provide a saving with respect to the number of locations at which gluing is required.

BRIEF DESCRIPTION OF THE DRAWING

The above and other objects, features, and advantages will become more readily apparent from the following description, reference being made to the accompanying drawing in which:

FIG. 3 is a is a view of the reverse side showing the folding of the slide panel into its position underlying the front panel;

FIG. 5 is a view of the reverse side of the card in which the rear panel has been folded over to underlie the front panel, FIG. 5 representing the card as it may be supplied to the consumer;

FIG. 6 is a view of the reverse side of the card after the tear-away strip has been removed;

FIG. 7 is a view of the obverse side, i.e. showing the front panel in elevation, after the tear-away strip has been removed;

FIG. 8 is a cross sectional view along the line VIII—VIII of FIG. 6;

FIG. 9 is a diagrammatic perspective view showing the erection of the cutout portion of the card of FIGS. 5–7;

FIG. 12 is a plan view of a blank for producing a pop-up card according to another embodiment of the invention;

FIG. 13 is a similar view of the blank after partial folding of the application of glue thereto;

FIG. 14 is a plan view of the opposite side of the card after it has been completely assembled;

SPECIFIC DESCRIPTION

Figure 1:
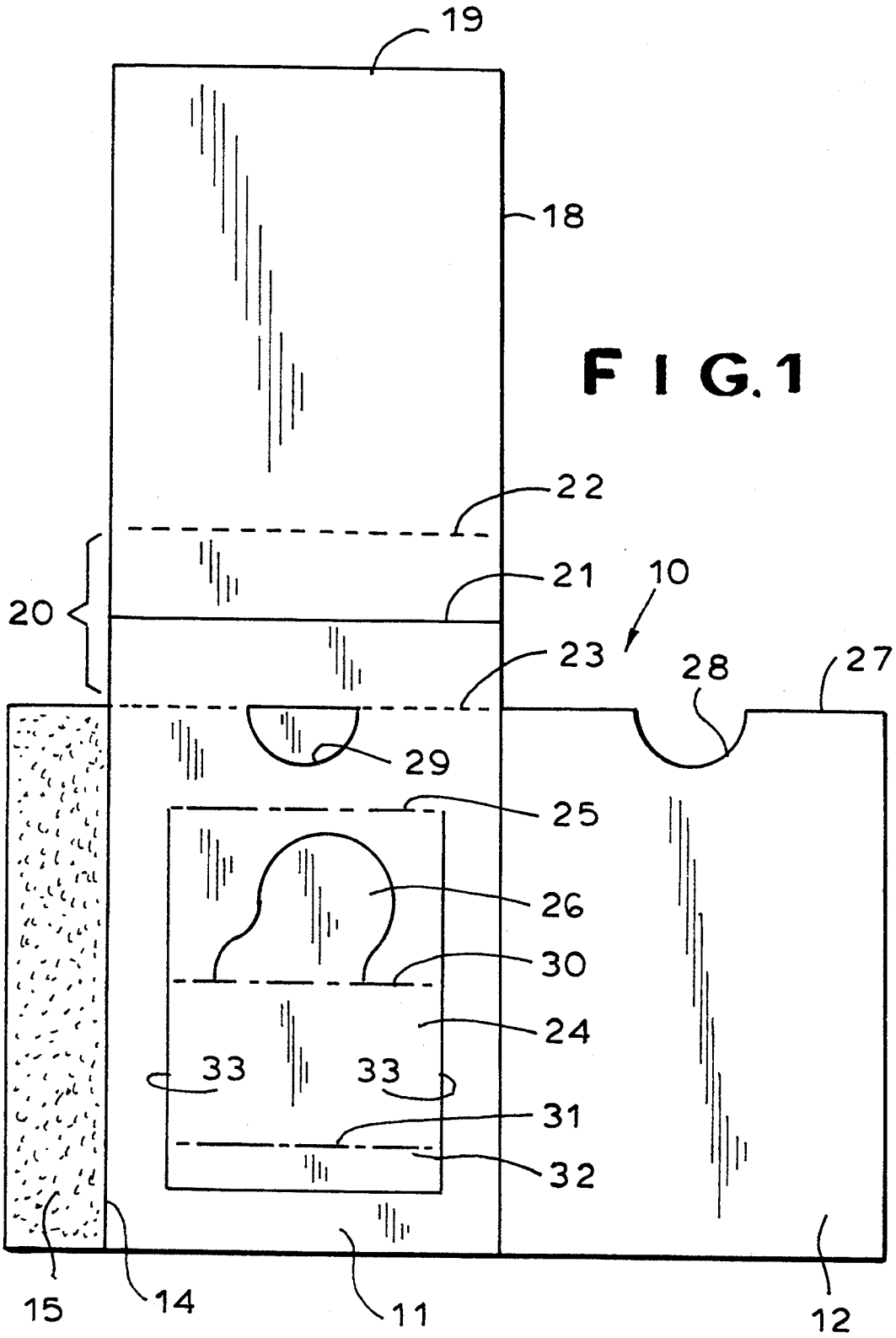
FIG. 1 is a plan view of the front or obverse side of the die-cut blank according to the invention after the imprinting thereof but prior to the folding or gluing.

In FIG. 1 of the drawing, I have shown a blank 10 which can be cut from paper or paper board stock and which comprises a front panel 11 and a rear panel 12 which is unitary with the front panel 11 at a lateral edge 13 thereof along which a fold line may be scored.

Along the opposite scored edge 14, a flap 15 is affixed. A trace of glue can be provided along this flap, if desired, for gluing to the rear panel 12 along a zone 16 thereof delimited by a dot-dash line 17 in FIG. 2. Alternatively, the glue trace can be provided along the rear panel. A slide panel 18 having a free edge 19 is connected by a tear-away strip 20 which may be scored with a fold line 21, with the front panel 11 and by two weakened lines 22 and 23, shown as perforations.

The front panel 11 is also provided with a cutout section 24 which can be connected at a scored line or hinge with the remainder of the front panel forming a frame for this cutout portion. The cutout portion 24 has a pop-up part 26 which can be in the configuration of the full figure or bust of a prominent individual, such as an athlete, whose biographical data, prowess or achievements may be depicted by legible matter imprinted on all of the surfaces visible in FIG. 1 with the exception of the tear-away strip 20 and the flap 15 since these ultimately will not be visible when the card is used.

In the die cutting process, along the upper edge 27 of the rear panel 12, a notch 28 can be formed which can register with a notch 29 formed along the line of perforations 23 to constitute indentations through which the upper edge of the slide 18 is accessible when the slide is to be pulled to erect the cutout formation 26. Furthermore, to facilitate bending of the cutout portion 24, the latter may be scored with a fold at 30, the purpose of which is described subsequently. Finally, with respect to FIG. 1, a dot-dash line 31 is shown to delimit the zone 32, on the reverse of which a glue trace can attach the pop-up portion to the slide panel 18 as will be described.

Note that the lateral edges 33 of the cutout portion 24 do not extend beneath the frame formed by the remainder of the panel 11 and that no rails are provided for the cutout portion to serve as guides which must be attached in an additional step.

Figure 2:
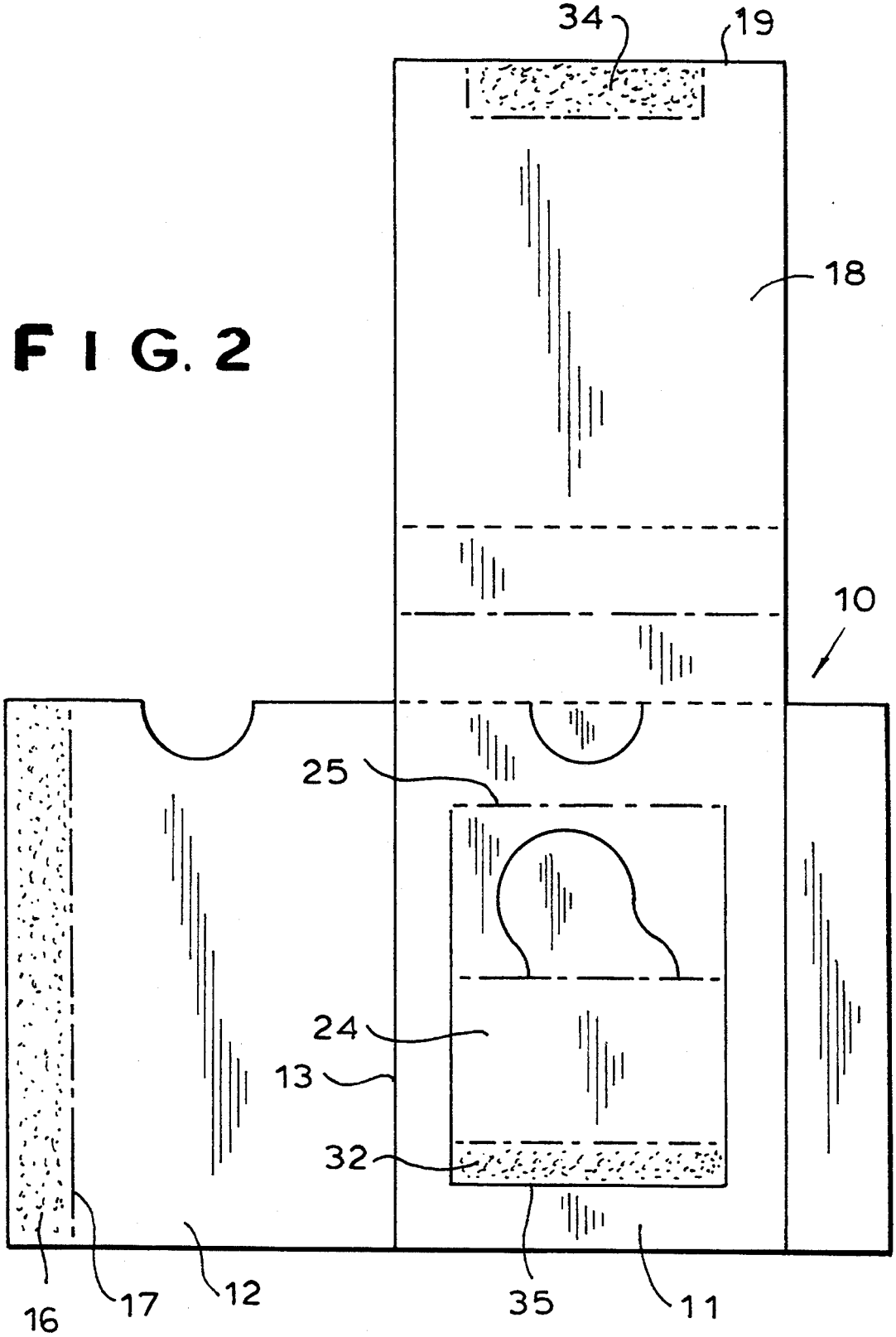
FIG. 2 is a plan view of the reverse side of the blank.

Running to FIG. 2, where the glue trace has been represented as being provided on the cutout portion 24 at its reverse side or in a zone 34 of the reverse side of the slide panel 18, all of the basic elements of the blank 10 are visible. No here-visible surface of the reverse of the blank need be imprinted.

In the folding of the blank (see FIGS. 3–5), the slide panel 18 is first folded along the fold line 21 to underlie the front panel 11 so that the lower edge or free edge 17 of the slide panel coincides with the free edge 35 of the cutout portion 24. The glue trace on the zone 34 or 32 thus bonds the part of the cutout portion 24 which is remote from the hinged line 25 to the slide panel 18.

Figure 4:
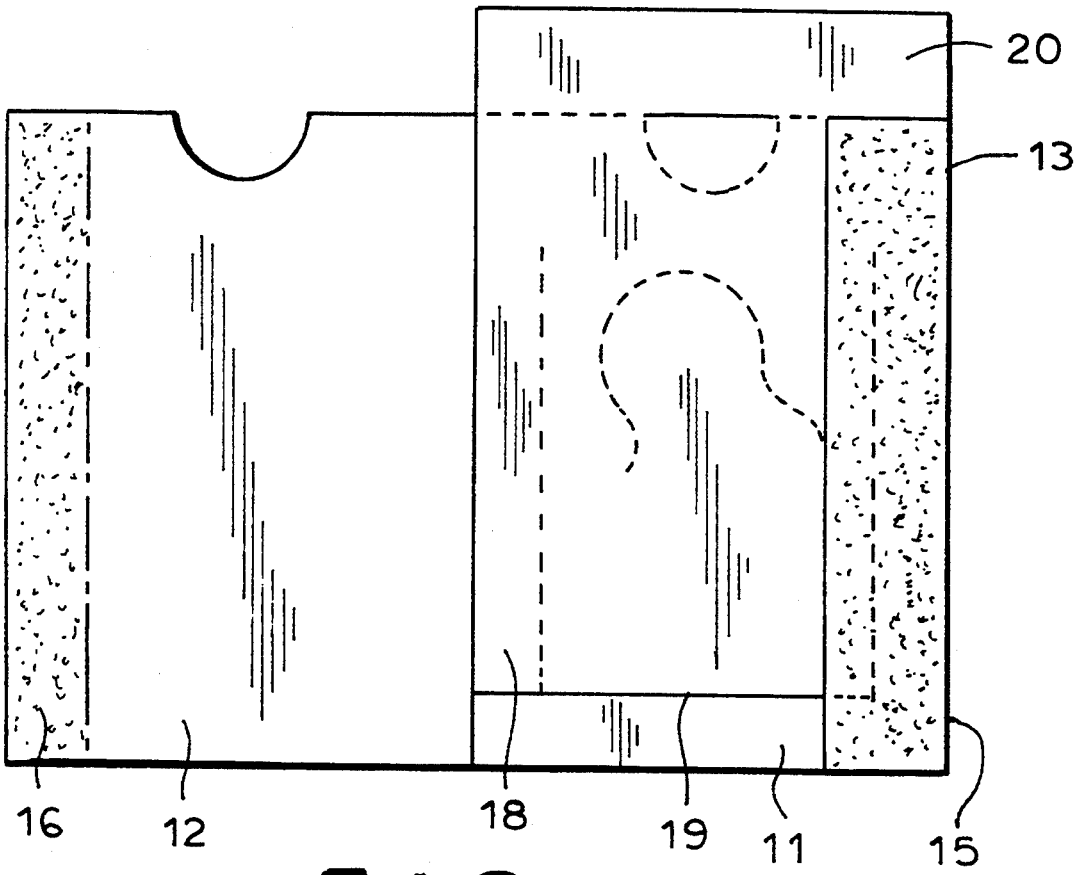
FIG. 4 is a view similar to FIG. 3 but showing the folding in of the flap.

Comparing FIGS. 3 and 4 it can be seen that the flap 15 is then turned over the slide portion 18 along the fold edge 14 and bears a glue trace adapted to bond to the zone 16. Alternatively, the glue trace is provided on this zone.

Hence upon the folding over of the rear panel 12 about the edge 13 (compare FIGS. 4 and 5) the completed card results.

It will be understood that, when the glue traces are provided at 34 or 32 and at 16, it is only necessary to apply the glue to the reverse of the blank and thus gluing is simplified.

The tear away strip 20 can then be removed (compare FIG. 5 with FIGS. 6 and 7), to liberate the slide panel 18 which can be grouped through the notches or indentations 28 and 29 so that when the slide panel 18 is pulled upwardly (FIG. 9), the cutout portion 24 is likewise drawn upwardly, folds along the fold lines 30 and 31 which can be scored in the cutout portion 24 to erect the part 26. In this case, the cutout portion 24 is literally guided by parts 40 of the full width slide portion 18 underlying the frame members 41 of the front panel 11.

Of course, the panel 18 can be connected to the rear panel 12 by the tear-away strip 20 with substantially the same effect in a less preferred embodiment.

Figure 10:
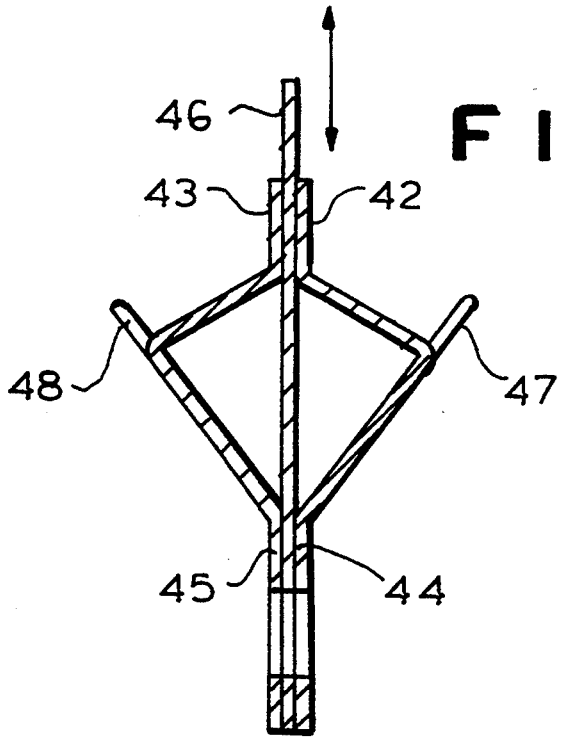
FIG. 10 is a cross sectional view through a dual pop-up card according to the invention.

As can be seen from FIG. 10, both of the panels 42 and 43, either of which can be considered the front or rear panels and which form the sleeve, can be provided with cutout portions 44 and 45 which are glued to opposite sides of the slide 46 so that, when that slide is drawn out of the sleeve, the pop-up portions 47 and 48 are erected on opposite sides of the card and collectively provide a spring action tending to retract the slide into the sleeve. The construction of FIG. 10 can be fabricated in the manner already described simply by providing the rear panel with a respective cutout portion and gluing the same to the slide in a manner analogous to the gluing of the front panel cutout portion to the latter.

Figure 11:
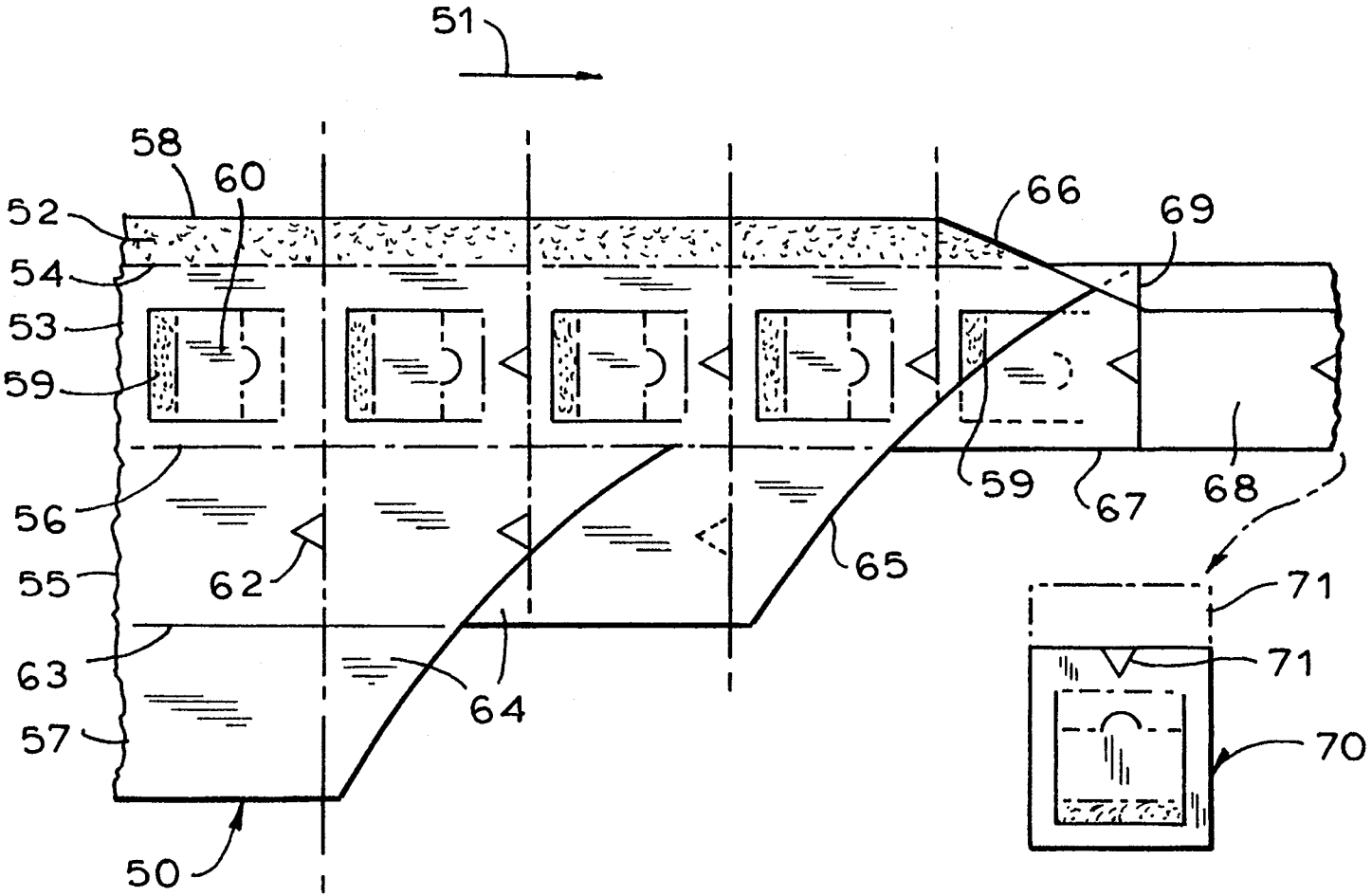
FIG. 11 is a diagram illustrating the production of pop-up cards according to the invention on a web press.

In FIG. 11 I have diagrammatically illustrated a continuous method of fabricating the pop-up cards utilizing, for example, a web press. In this method, a continuous web 50 is fed in a web feed direction 51 and comprises a plurality of adjoining portions which ultimately will form the panels of the pop-up card. These portions include a flap portion 52 adjoining the front panel portion 53 at a score line 54, a rear panel portion 55 adjoining the front panel portion 53 at a score line 56 and a slide portion 57 adjoining the rear panel portion 55. As shown in the drawing the blank 50 may have previously been provided with the score lines 54 and 56 and with a strip of glue 58 along the flap 52 and a further glue strip 59 at the free end of the cutout portion 60 which, like the notches 61 and 62, can have previously been die cut in the blank.

According to this aspect of the invention, as the continuous web 50 is fed in the direction 51 the strip 57 is slit longitudinally from the web as represented by the slit shown at 63 and the now free portion of the slide strip represented at 64 is folded over the rear panel 55. As represented diagrammatically by the line 65, the front and rear panels are then continuously folded together during the advance in the direction 51 to sandwich the slide strip 64 between them and glue the slide strip to the glue strip 59 of each cutout portion with which that slide strip comes into contact. The flap portion 52 is then folded at 66 over the rear panel portion to close the sleeve. From the continuous sleeve thus formed at 67, a portion 68 equal to the length of the card can be severed transversely along the cutting line 69 to produce the completed card 70 shown in FIG. 11 and thereby liberating the slide 71 which can be pulled out to include pop-up of the cutout portion.

The blank 80 shown in FIG. 12 comprises a front panel 81 and a rear panel 82 which is unitary with the front panel 81 at a lateral edge adapted to be formed along a fold line 83 which can be scored in the blank when the latter is die cut.

Along the opposite score line 84, a flap 85 is integral with the front panel. A trace of glue 86 can be provided on this flap (see FIG. 3) if desired for gluing to the rear panel. Alternatively, the glue trace can be provided along the rear panel where the flap meets it upon folding of the card.

A slide panel 88 here has a fold line 89 connecting it with a pop-up portion 90 delimited in the front panel by a pair of cut edges 91 and 92 incised in the blank during the die cutting operation. On opposite sides of the fold line 89, the slide panel 88 is cut away from the front panel 81 by the incisions 93 and 94.

The pop-up portion 90, moreover, is connected by a scored fold line 95 with the front panel 81 at its end opposite the fold line 89, and has an intermediate fold line 96 scored therein to allow the pop-up portion to fold together when the slide panel 88 is drawn out of the sleeve formed by the front and rear panels and the flap 85.

The slide panel 88 is initially folded about the line 88 and at the incisions 93, 94 to form the lower edge 97 (FIG. 13) as the slide panel is folded over the front panel 81. The front and rear panels 81 and 82 are provided with notches 98 and 99 which register with one another to allow the slide panel 88 to be gripped by the fingers of the user.

In the subsequent step, the rear panel 82 is folded over the slide panel 88 and glued to the folded over flap 85. The flap can be glued under or over the rear panel 82. The completed pop-up card is shown in FIG. 14.

Figure 15:
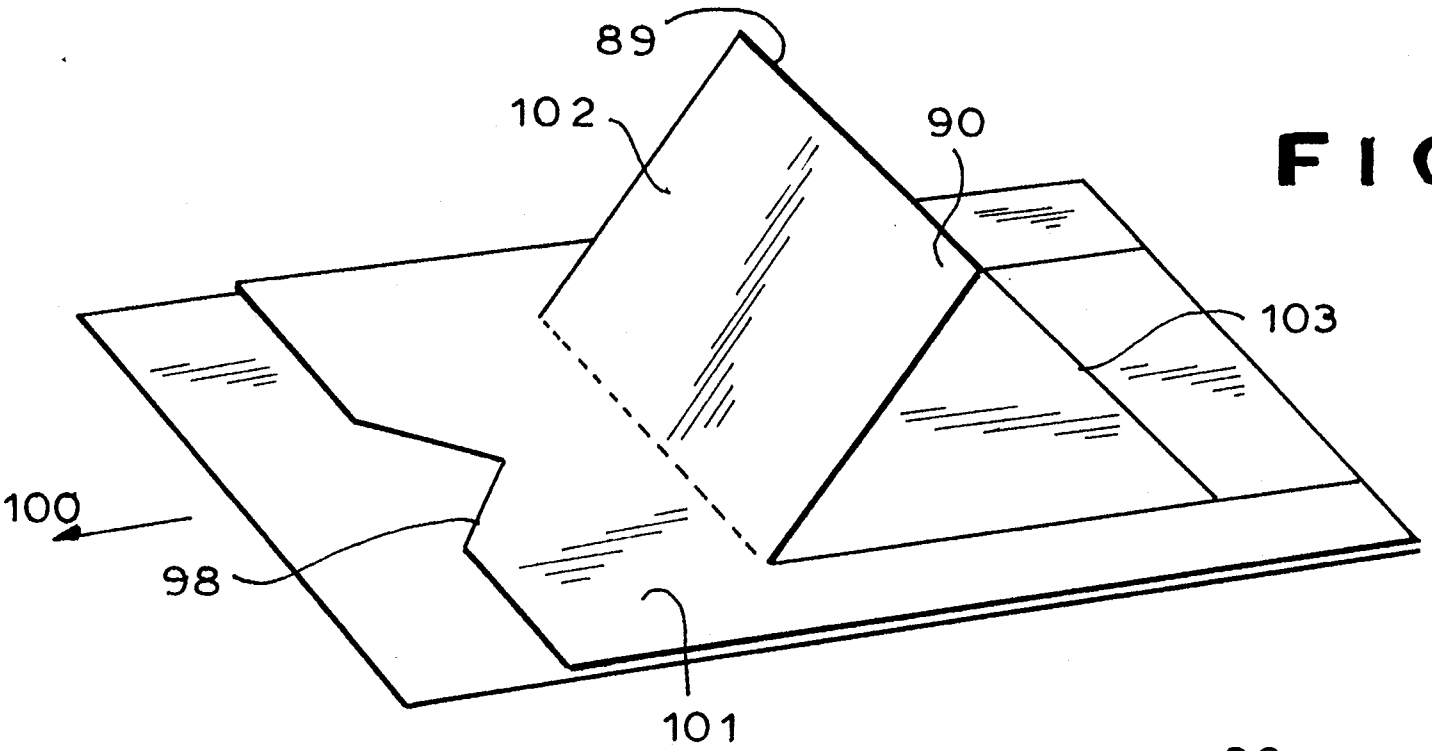
FIG. 15 is a perspective view of this latter embodiment.
Figure 16:
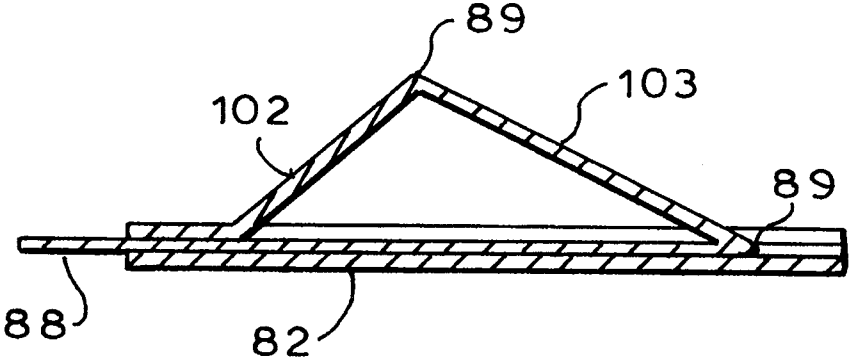
FIG. 16 is a cross sectional view through the card of FIGS. 12–15.

When the slide panel 88 is pulled upwardly as represented by the arrow 100, relative to the sleeve 101 formed by the front and rear panels and the flap 85 (FIG. 15), the fold line 89 is drawn upwardly to cause the pop-up portion 90 to project from the card, with the sections 102 and 103 of the pop-up portion being folded together along the score line 89 (FIG. 15). In this case a separate gluing of the pop-up portion is unnecessary and the slide panel 88 is nevertheless substantially the full width of the front and rear panels.

I claim:

1. A pop-up card, comprising:

a front panel bounded by edges and formed inwardly of said edges with cuts delimiting a pop-up portion of said front panel having a cutout adapted to be erected upon bending of said pop-up portion by drawing an extremity thereof toward a portion of the pop-up portion hinged to a remainder of said front panel;

a slide panel of substantially a full width of said front panel, underlying said front panel and secured to said pop-up portion substantially at said extremity;

a rear panel underlying said slide panel and connected to said front panel along one of said edges thereof, said front and rear panels sandwiching said slide panel between them; and whereby said slide panel slides without rail guidance between said front and rear panels.

2. A pop-up card, comprising:

a front panel bounded by edges and formed inwardly of said edges with cuts delimiting a pop-up portion of said front panel having a cutout adapted to be erected upon bending of said pop-up portion by drawing an extremity thereof toward a portion of the pop-up portion hinged to a remainder of said front panel;

a slide panel of substantially a full width of said front panel, underlying said front panel and secured to said pop-up portion substantially at said extremity;

a rear panel underlying said slide panel and connected to said front panel along one of said edges thereof, said front and rear panels sandwiching said slide panel between them; and a tear-away strip connected by weakened lines with said slide panel and with one of said front and rear panels and provided with a fold between said weakened lines, said tear-away strip being separable from the pop-up card along said lines to free said slide panel to be displaced by a user to erect said cutout.

3. The pop-up card defined in claim 2 wherein said front, slide and rear panels and said tear-away strip are unitary with one another and form parts of a common die-cut blank.

4. The pop-up card defined in claim 3 wherein said tear-away strip connects said slide panel with said front panel.

5. The pop-up card defined in claim 4 wherein said front panel is formed unitarily with a flap along an edge thereof opposite the edge along which said rear panel is connected to said front panel, said flap being folded to underlie said front panel and being connected to said rear panel.

6. The pop-up card defined in claim 5 wherein said rear panel is glued to said flap.

7. The pop-up card defined in claim 5 wherein said slide panel is glued to said pop-up portion.

8. The pop-up card defined in claim 7 wherein said rear panel is glued to said flap and the only parts of the card which are glued together are said slide panel and said pop-up portion and said flap and said rear panel.

9. The pop-up card defined in claim 5 wherein said panels are all rectangular.

10. The pop-up card defined in claim 5 wherein said front and rear panels are provided with notches through which said slide panel is accessible to permit manipulation of said slide panel.

11. The pop-up card defined in claim 10 wherein said rear panel is glued to said flap.

12. The pop-up card defined in claim 10 wherein said slide panel is glued to said pop-up portion.

13. The pop-up card defined in claim 12 wherein said rear panel is glued to said flap and the only parts of the card which are glued together are said slide panel and said pop-up portion and said flap and said rear panel.

14. The pop-up card defined in claim 13 wherein said panels are all rectangular.

15. The pop-up card defined in claim 1 wherein said rear panel is formed inwardly of edges thereof with cuts delimiting a pop-up portion of said rear panel having a cutout adapted to be erected upon bending of said pop-up portion of said rear panel by drawing an extremity thereof toward a portion of the pop-up portion of the rear panel hinged to a remainder of the rear panel and said extremity of the pop-up portion of the rear panel is affixed to said slide panel.

16. The pop-up card defined in claim 1 which is severed from a continuous sleeve formed by continuous folding of said panels on a continuous web.

17. The pop-up card defined in claim 1 wherein said slide panel is formed in one piece with said pop-up portion at its extremity and said extremity lies along an edge of said card.

18. The pop-up card defined in claim 1 wherein said pop-up portion has a cutout projecting from said pop-up portion upon erection thereof.

* * * * *